US006059560A

United States Patent [19]

Richards et al.

[11] Patent Number: 6,059,560

[45] Date of Patent: May 9, 2000

[54] PERIODIC EQUIVALENCE RATIO MODULATION METHOD AND APPARATUS FOR CONTROLLING COMBUSTION INSTABILITY

[75] Inventors: George A. Richards, Morgantown, W. Va.; Michael C. Janus, Baltimore, Md.; Richard A. Griffith, Morgantown, W. Va.

[73] Assignee: The United States of America as represented by the United States Department of Energy, Washington, D.C.

[21] Appl. No.: 09/034,613

[22] Filed: Mar. 3, 1998

Related U.S. Application Data

[60] Provisional application No. 60/039,500, Mar. 4, 1997.

[51] Int. Cl.[7] ..... F23C 11/04; F23D 1/00

[52] U.S. Cl. ..... 431/1; 431/114; 60/39.06; 60/39.281

[58] Field of Search ..... 431/1, 114; 60/39.06, 60/39.281

*Primary Examiner*—Larry Jones

*Attorney, Agent, or Firm*—Bradley W. Smith; Mark P. Dvorscak; William R. Moser

[57] ABSTRACT

The periodic equivalence ratio modulation (PERM) method and apparatus significantly reduces and/or eliminates unstable conditions within a combustion chamber. The method involves modulating the equivalence ratio for the combustion device, such that the combustion device periodically operates outside of an identified unstable oscillation region. The equivalence ratio is modulated between preselected reference points, according to the shape of the oscillation region and operating parameters of the system. Preferably, the equivalence ratio is modulated from a first stable condition to a second stable condition, and, alternatively, the equivalence ratio is modulated from a stable condition to an unstable condition. The method is further applicable to multi-nozzle combustor designs, whereby individual nozzles are alternately modulated from stable to unstable conditions. Periodic equivalence ratio modulation (PERM) is accomplished by active control involving periodic, low frequency fuel modulation, whereby low frequency fuel pulses are injected into the main fuel delivery. Importantly, the fuel pulses are injected at a rate so as not to affect the desired time-average equivalence ratio for the combustion device.

20 Claims, 9 Drawing Sheets

FIG. 7 Example of PERM applied to a single-sided instability. Notice that the oscilliation is modulated, but not removed by the PERM technique.

TEST OF PERM AT 20Hz CONTROL FREQUENCIES

TEST OF PERM AT 50Hz CONTROL FREQUENCIES

FIG. 10 Nozzle A
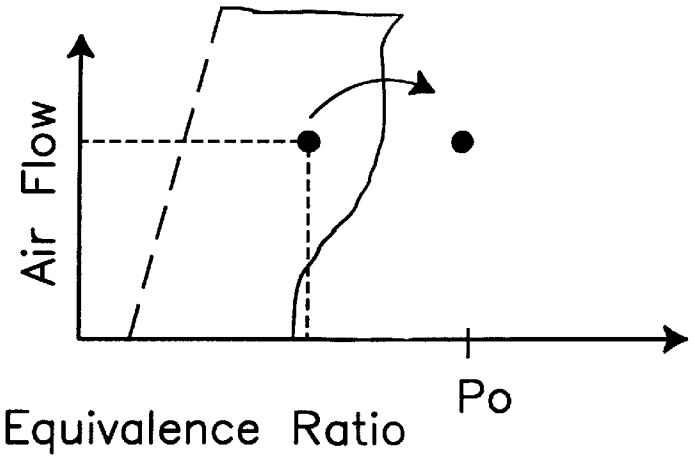
FIG. 11 Nozzle B
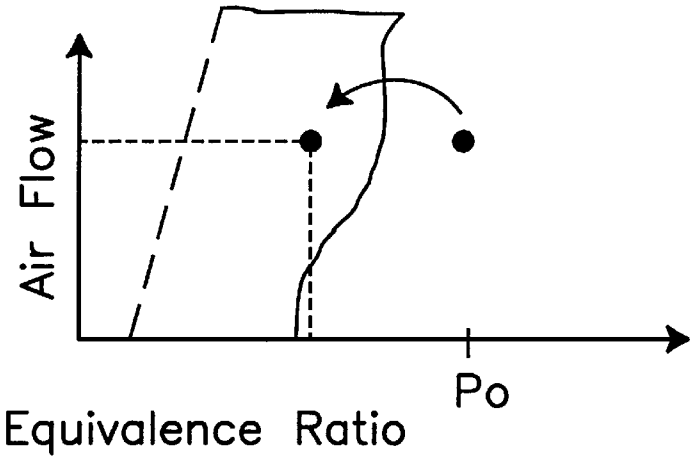
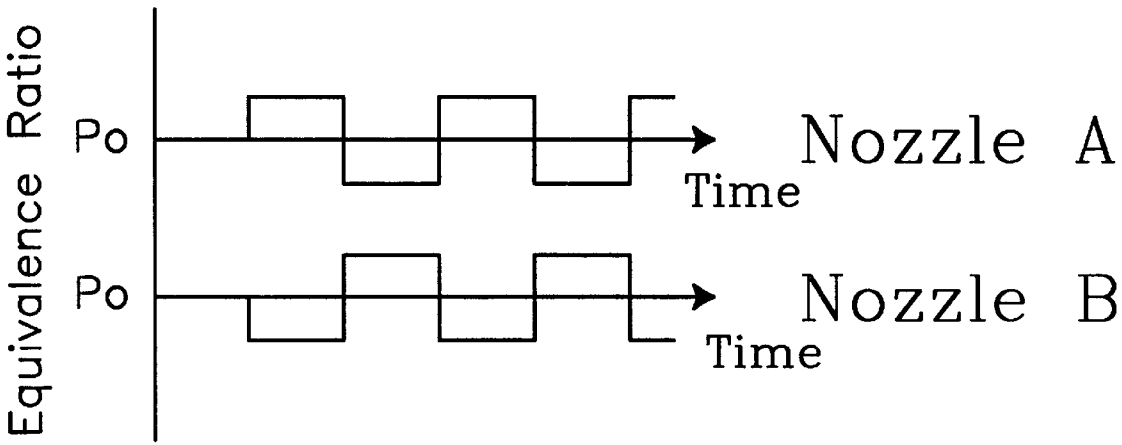
FIG. 12

PERIODIC EQUIVALENCE RATIO MODULATION METHOD AND APPARATUS FOR CONTROLLING COMBUSTION INSTABILITY

This application claims priority from Provisional Application No. 60/039,500 filed on Mar. 4, 1997. This application was filed during the term of the before mentioned Provisional Application.

CONTRACTUAL ORIGIN OF THE INVENTION

The United States Government has rights in this invention pursuant to the employer-employee relationship of the U.S. Department of Energy and the inventor(s).

TECHNICAL FIELD

The present invention relates to a method and apparatus for significantly reducing combustion instability, and, in particular, pressure oscillations within a combustion chamber. The method and apparatus employ active control for modulating the fuel/air equivalence ratio between a first stable condition and a second stable condition, or, alternatively, between a stable condition and an unstable condition.

BACKGROUND OF INVENTION

Combustion instability has been a continuing problem in the design of low-emission, high performing combustion chambers for gas turbines, boilers, heaters, furnaces, and other devices. Combustion instability is generally understood as high amplitude pressure oscillations that occur within the combustion chamber due to the turbulent nature of the combustion process and large volumetric energy release within the closed cavity of the combustion chamber. Many factors may contribute to a stable or an unstable state within the combustion chamber, including the fuel content, fuel and/or air injection speed or inlet pressure, fuel/air concentration, temperature changes within the combustion chamber, and/or the stability of the flame. Operating instabilities may further be amplified by the physical mechanisms of a particular combustion system design. Unfortunately, combustion instability diminishes engine system performance, and the vibrations resulting from pressure oscillations can potentially cause severe damage to hardware components, including the combustion chamber.

Conventional approaches for correcting combustion instability have involved passive control methods, such as changing the design of the combustor and/or revising the operating conditions. Examples of passive control are modification of the fuel injection distribution pattern, and changing the shape or capacity of the combustion chamber. Passive controls are often very costly and place unacceptable limits on combustor performance.

Recently, active controls have been developed to modulate certain aspects of the combustor environment to counteract the variable heat release within the combustion chamber that leads to an oscillating condition. Active controls may modify the pressure within the system and/or regulate the fuel or air flow into the system in response to detected unstable conditions. For example, a common method of active control is fuel or air metering, involving monitoring the stability of the combustion chamber, detecting and characterizing the instability, and cycling the flow of fuel or air injected into the chamber at the same frequency which produces the undesired oscillation, but at a phase angle such that the imposed modulation cancels, or effectively suppresses, the undesired oscillation. The fuel or air modulation is designed to counteract the oscillation in each cycle, and, therefore, relatively high frequency actuators are necessary. Disadvantages of active control incorporating high frequency modulation are the necessity of high frequency actuators and a detailed understanding of the actuator effect.

Controlling combustion instability is of increasing concern, as current attention is directed to high efficiency combustion systems that have very low exhaust emission levels, including emissions of $NO_x$ and CO pollutants. These systems generally involve lean premixing (LPM) strategies, wherein the fuel and air are thoroughly mixed prior to combustion, such that the resulting concentration of the fuel and air mixture minimizes the generation of pollutants upon combustion. This lean fuel and air concentration is approximately half the stoichiometric concentration required for combustion (i.e. self-supporting reactions), and therefore, combustion instability may cause even greater problems in LPM systems than in combustion systems operating at the stoichiometric fuel/air concentration. For example, as the fuel/air concentration approaches the stoichiometric limit for sustained combustion (the lean blow-out boundary), the variation of combustion temperature with fuel/air concentration becomes much greater, even to the point of extinguishing the flame. In addition, small changes in fuel/air concentration may result in large fluctuations, or oscillations, in temperature and pressure.

A need continues in the art for a low-cost, easily installed method and apparatus for actively controlling combustion instability.

The present periodic equivalence ratio modulation (PERM) method and apparatus is a unique approach for actively controlling oscillations within a combustion chamber. More specifically, the method involves periodically modulating the equivalence ratio for a combustion device, such that the combustion device operates in alternate stable conditions, or in alternate stable and unstable conditions. The periodic modulation is achieved by producing cycles of low frequency pulses of fuel applied over, or in addition to, the main fuel line control, which determines the fuel flow rate through the combustion system, and, therefore, the desired time-average equivalence ratio. In this way, the periodic equivalence ratio modulation (PERM) technique maintains the desired time-average equivalence ratio, while effectively controlling the pressure oscillations within the combustion chamber to eliminate or significantly reduce combustion instability.

Therefore, in view of the above, a basic object of the present invention is to provide a low-cost, easily installed method and apparatus for actively controlling combustion instability.

A further object of this invention is to provide active control for combustion instability that utilizes commercially available hardware.

Another object of this invention is to provide active control for combustion instability that is installed outside of the combustion chamber components, i.e. the engine pressure casing on a gas turbine.

Yet another object of this invention is to provide active control for combustion instability that is applicable to LPM systems.

Yet another object of this invention is to provide active control for combustion instability that is not limited to operation at the acoustic frequency of the combustor.

Yet another object of this invention is to provide active control for combustion instability that reduces pollutant emissions.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of instrumentation and combinations particularly pointed out in the appended claims.

BRIEF SUMMARY OF THE INVENTION

The present invention relates to a method and apparatus for significantly reducing and/or eliminating unstable conditions within a combustion chamber by periodically modulating the equivalence ratio of the fuel/air mixture between two preselected equivalence ratio values. (Equivalence ratio is the ratio of the actual fuel/air mixture to the stoichiometric fuel/air mixture for a combustion device).

The present periodic equivalence ratio modulation (PERM) method first involves plotting air flow versus equivalence ratio over the operating range for a combustion device. Second, an oscillation region is identified, wherein the combustion device operates in an unstable condition. The oscillation region has corresponding ranges of air flow rates and equivalence ratio values. Next, for a combustion device operating in an unstable condition, the desired operating point, which is predetermined by the combustor design, is located within the oscillation region. The desired operating point corresponds to a desired air flow rate and a desired equivalence ratio. Two reference points are selected according to the operating parameters of the system and the shape of the identified oscillation region. At least one of the reference points is outside of the identified oscillation region. Combustion instability is then actively controlled by periodically modulating the equivalence ratio for the combustion device between the equivalence ratio values corresponding to the two preselected reference points. Importantly, the equivalence ratio is modulated at a low frequency, such that the time-average equivalence ratio for the combustion device is unaffected by the active control.

Ideally, the oscillation region has an island shape, and the first and second reference points are within the operating range and on either side of the oscillation region. Alternatively, where the oscillation region is single-sided, the first reference point is within the oscillation region and the second reference point is within the operating range and outside of the oscillation region.

PERM is accomplished by active control involving low frequency fuel modulation, whereby low frequency fuel pulses are injected into the main fuel line delivering fuel to the fuel injector and combustion chamber. The PERM apparatus is the hardware or means for introducing the periodic, low frequency fuel pulses into the combustion system. The preferred embodiment of the apparatus includes: (1) an accumulator for containing a reservoir of fuel; (2) a solenoid valve for controlling the discharge of fuel from the accumulator into the main fuel line; (3) a drive circuit for controlling the solenoid valve; and (4) an orifice in the main fuel line for creating a pressure drop between the accumulator inlet and outlet ports. When the solenoid valve is closed, the accumulator receives fuel, and when the solenoid valve is open, the accumulator discharges fuel. In operation, the solenoid valve is opened and closed at a predetermined rate, such that fuel pulses cause the actual equivalence ratio to modulate between the equivalence ratio values corresponding to the two preselected reference points.

For a multi-nozzle combustion device having more than one fuel injector, the PERM technique is applied to individual nozzles to reduce or eliminate combustor instability. The individually applied periodic modulation of fuel to the fuel injectors is coordinated in such a way so as to decrease the instability of the overall combustion system. For example, for a two-nozzle system, the equivalence ratio of the first nozzle is periodically modulated 180° out of phase of the periodic equivalence ratio modulation applied to the second nozzle.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 10 is a graphical representation of the modulation of the equivalence ratio between stable and unstable conditions for Nozzle A;

FIG. 11 is a graphical representation of the modulation of the equivalence ratio between stable and unstable conditions for Nozzle B; and FIG. 12 is a graphical representation of the time history for Nozzle A and Nozzle B.

DETAILED DESCRIPTION OF THE INVENTION

The present invention relates to a periodic equivalence ratio modulation (PERM) method and apparatus for significantly reducing and/or eliminating unstable conditions within a combustion chamber. The method involves modulating the equivalence ratio for the combustion device, such that the combustion device periodically operates outside of an identified unstable oscillation region. Thus, by periodically restructuring the combustion flame, pressure oscillations within the combustion chamber are effectively avoided.

Combustion is the rapid chemical combination of oxygen (e.g. air) with the combustible elements of fuel (e.g. carbon, hydrogen, sulfur) at a temperature high enough to ignite the constituents and with sufficient mixing, or turbulence. A stoichiometric combustion reaction ratio is definable for any fuel/air concentration and represents the unique reaction in which all of the reactants are consumed and converted to products. The equivalence ratio for a fuel/air concentration is defined as the ratio of the actual fuel/air ratio to the stoichiometric fuel/air ratio. For example, an equivalence ratio of 1 means the fuel supplied is the amount required to consume all of the air, a fuel/air ratio of greater than 1 indicates a rich fuel/air concentration that is greater than stoichiometrically necessary, and a fuel/air ratio of less than 1 indicates a lean fuel/air concentration that is less than stoichiometrically necessary. For given temperature and pressure conditions, fuel and air mixtures are flammable only within a certain range of equivalence ratios.

Figure 1:
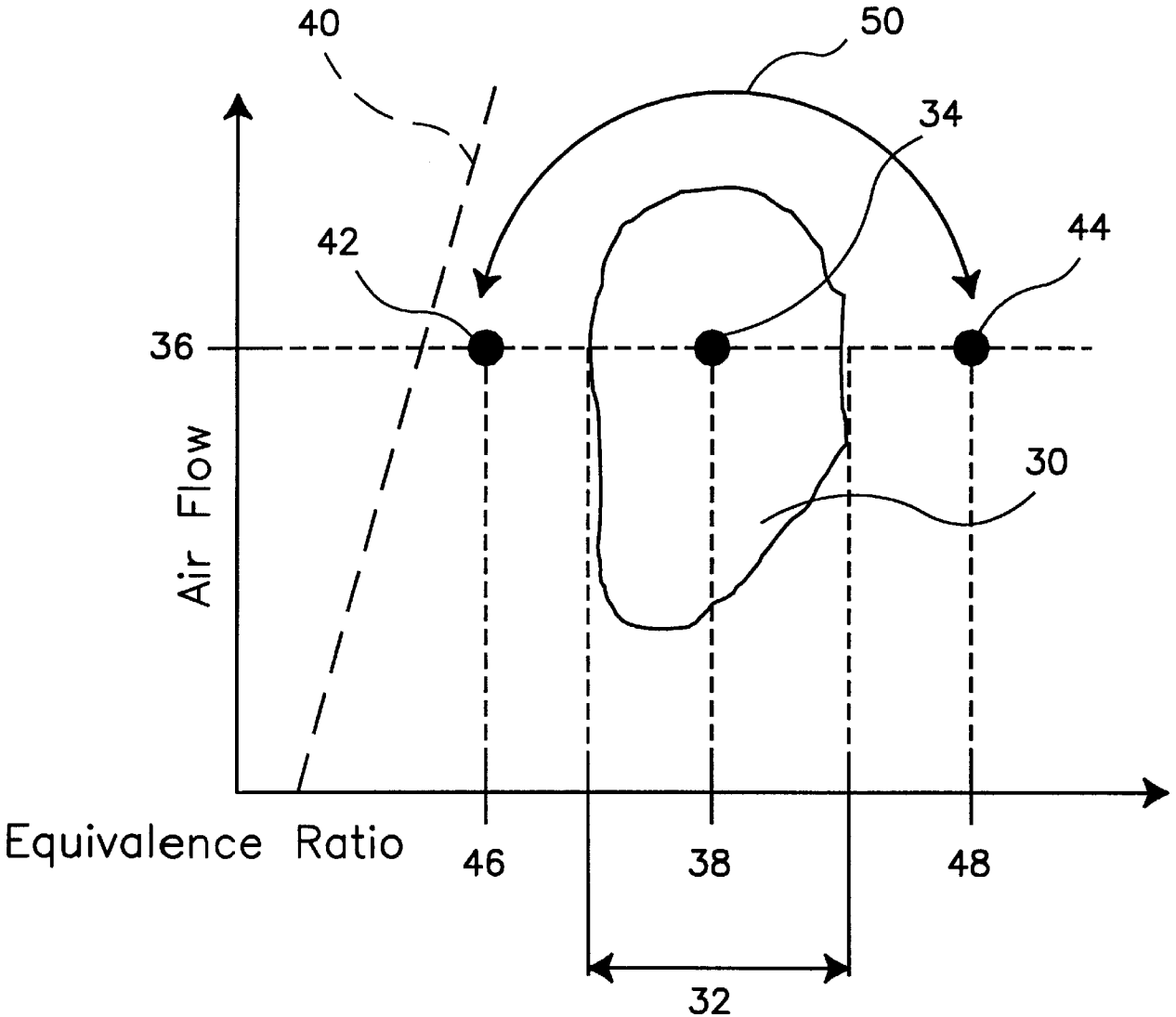
FIG. 1 is a graphical representation of a combustion device having an island shaped oscillation region.

Combustion instability is graphically demonstrated for a combustion device by plotting air flow rate versus equivalence ratio. (Air flow rate is the rate air is injected into the combustion chamber, e.g. nozzle air flow rate, and equivalence ratio is defined above.) Such a graph is shown in FIG. 1, identifying a shaded oscillation region 30, wherein the combustion device operates in an unstable condition. For a given air flow rate, there corresponds a range of equivalence ratio values within the oscillation region, referred to herein as the unstable equivalence ratio range 32. The desired operating point 34 for a combustion device is determined by the physical construction and operating parameters of the combustion device. Operating the combustion device at the desired operating point results in a desired time-average equivalence value for the combustion system. For a combustion system experiencing instability, the desired operating point 34 is within the oscillation region and has a corresponding desired air flow rate 36 and desired equivalence ratio value 38.

The operating range for a combustion device is finite: equivalence ratio values cannot be less than required to sustain combustion and cannot be greater than allowable by the physical constraints of the combustion device. The lean blow-out boundary line 40 relates to lean premixing (LPM) combustion designs, wherein the fuel/air ratio is significantly less than the stoichiometric concentration. The lean blow-out boundary line 40 indicates operating conditions below which the fuel/air concentration is too lean to support combustion, i.e. the combustion flame is extinguished. Of course, any active control must maintain the actual operating point to the right of the lean blow-out boundary line 40.

The PERM method involves constructing a graph of air flow rate versus equivalence ratio over the operating range for a combustion device, as illustrated in FIG. 1, and identifying the oscillation region 30. The desired operating point 34 is plotted on the graph, and if it falls within the identified oscillation region, then the combustion device is operating in an unstable condition and requires PERM active control. As described above, the desired operating point 34 corresponds to a desired air flow rate 36 and a desired equivalence ratio 38. The next step, unique to the PERM technique, is to select reference points according to the operating parameters of the system and the shape of the identified oscillation region 30. At least one of the reference points selected is outside of the identified oscillation region 30. Combustion instability is actively controlled by periodically modulating the equivalence ratio for the combustion device, such that the actual operating point modulates between the preselected reference points.

Selection of the reference points is dependent upon the operating parameters of the system and shape of the oscillation region. The preferred embodiment is shown in FIG. 1, wherein the identified oscillation region 30 has an island shape. For an island shaped oscillation region 30, two reference points 42, 44 are selected on either side of the oscillation region 30 and within the operating range for the combustion device. The first reference point 42 corresponds to the desired air flow rate 36 and has an equivalence ratio value 46 that is less than the lowest equivalence ratio value within the unstable equivalence ratio range 32. The second reference point 44 corresponds to the desired air flow rate 36 and has an equivalence ratio value 48 that is greater than the greatest equivalence ratio value within the unstable equivalence ratio range 32. Alternatively, variable air flow rates may be used to select the two reference points, as long as the first reference point has an equivalence ratio value less than the desired equivalence ratio 38, the second reference point has an equivalence ratio value greater than the desired equivalence ratio 38, and both the first and second reference points are outside of the oscillation region. The instability of the combustion device is actively controlled by periodically modulating the equivalence ratio between the equivalence ratio values corresponding to the two reference points 42, 44, such that the actual operating point moves from a first stable condition to a second stable condition, on either side of the oscillation region (indicated by the arrow 50 in FIG. 1).

An alternate embodiment of the PERM technique involves modulating the equivalence ratio for a combustion device, such that the operating point moves between a stable condition outside of the oscillation region and an unstable condition within the oscillation region. This embodiment is applicable to a combustion device having an island shaped oscillation region, by simply selecting one of the two reference points to be within the oscillation region. For example, in FIG. 1, the first reference point is selected as 34 and the second reference point is selected as 44, and the equivalence ratio is periodically modulated between values their corresponding equivalence ratio values 38, 48. More frequently, however, the oscillation region is not island shaped, but single-sided, as illustrated by FIG. 2.

Figure 2:
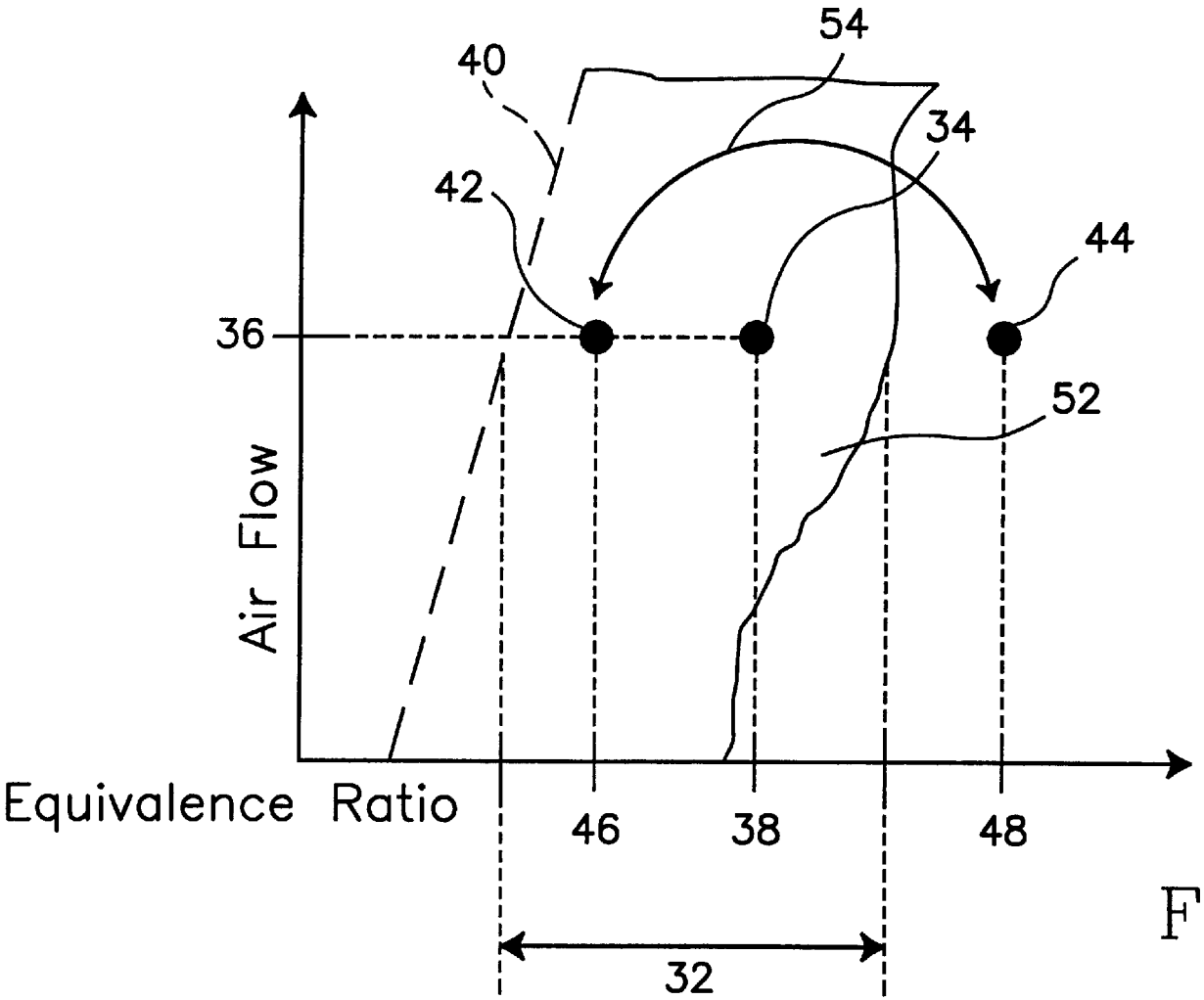
FIG. 2 is a graphical representation of a combustion device having a single-sided oscillation region.

In FIG. 2, a single-sided shaped oscillation region 52 has equivalence ratio values available for selection only to one side of the unstable equivalence ratio range 32. The oscillation region 52 is bounded because of constraints relating to the physics of combustion and the design of the combustion device (i.e. the lean blow-out boundary 40). Applying PERM to the single-sided case, it is not possible to modulate the equivalence ratio between two stable conditions on either side of the oscillation region 52. Rather, two reference points 42, 44 are selected, wherein the first reference point 42 is within the oscillation region 52 and the second reference point 44 is outside of the oscillation region 52. Preferably, the first reference point is the desired operating point 34 within the oscillation region 52, and the second reference point 44 corresponds to the desired air flow rate 36 and has an equivalence ratio outside of the unstable equivalence ratio range 32. Alternatively, variable air flow rates may be used to select the two reference points, as long as the first reference point is within the oscillation region 52, the second reference point is outside of the oscillation region 52, and both reference points are within the operating range for the combustion device. The instability of the combustion device is actively controlled by periodically modulating the equivalence ratio between the equivalence ratio values corresponding to the two reference points 42, 44 or 34, 44, such that the operating point moves between a stable condition and an unstable condition, as indicated by the arrow 54.

Importantly, the PERM technique includes modulating the equivalence ratio at a low frequency, such that the time-average equivalence ratio for the combustion device is unaffected by the active control. There are several methods known in the art for modulating an equivalence ratio for a combustion device. The PERM method uniquely involves changing the equivalence ratio by injecting low frequency pulses of fuel into the combustion system, while maintaining the time-average equivalence ratio at the desired operating point. An advantage of the low frequency fuel modulation of the PERM technique, in contrast to high frequency active controls, is that existing, commercially available solenoid valves may be employed to accomplish the required fuel pulse injection.

The present invention will be illustrated through a detailed description of its application in the connection and operation of a gas turbine engine, however, it will be obvious to those skilled in the art from the following descriptive material that the invention is likewise applicable to any combustion device, including but not limited to boilers, heaters, and aircraft gas turbines, and may be applied to systems consuming natural gas fuel, coal, oil, or any liquid, solid, or gaseous fuel.

Figure 3:
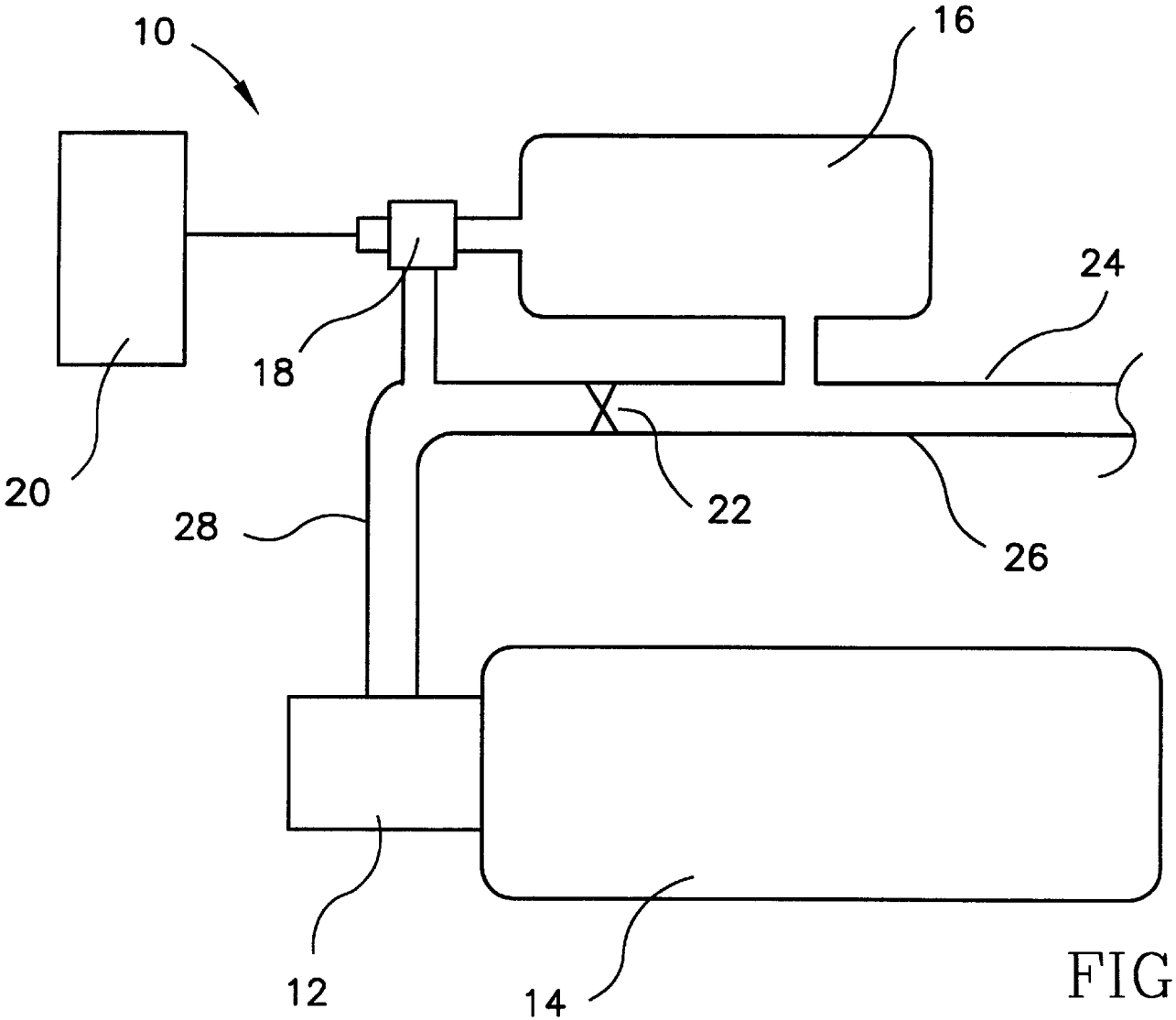
FIG. 3 is a schematic representation of the periodic equivalence ratio modulation (PERM) apparatus.

FIG. 3 shows the PERM apparatus 10 as applied to a standard gas turbine engine having a main fuel line 24, a main fuel line control valve (not shown), a single gas turbine fuel nozzle 12, and a combustion chamber 14. The apparatus 10 is comprised of an accumulator 16, which contains a reservoir of fuel for periodic injection into the main fuel line 24, a solenoid valve 18, which controls the pressure (amount of fuel) in the accumulator 16, and a driving circuit 20 for opening and closing the solenoid valve 18. Orifice 22 is provided in the main fuel line 24 to create a pressure drop, such that the main fuel line 24 is divided into an upstream section 26 and a downstream section 28. (An orifice is standard on existing multinozzle gas turbines to insure a uniform distribution of the fuel to all fuel injection nozzles). A main fuel line control valve (not shown) controls the fuel flow rate in the upstream section 26 of the main fuel line 24. In addition, pressure transducers (not shown) may be used for measuring the pressure conditions within the accumulator, upstream and downstream main fuel lines, and combustion chamber.

The solenoid valve 18 operates to produce periodic equivalence ratio modulation. When the solenoid valve 18 is closed, the accumulator 16 fills with fuel, attempting to equilibrate to the pressure within the fuel line 28 upstream of the orifice 22, referred to herein as the valve-closed equilibrium pressure. When the solenoid valve 18 is opened, a momentary increase in the fuel flow occurs, as the accumulator 16 discharges fuel to establish a lower pressure, referred to herein as the valve-open equilibrium pressure, and the fuel flow rate returns to the desired time-average value as determined by the main fuel line control valve. The desired periodic equivalence ratio modulation is achieved by opening and closing the solenoid valve 18, such that the accumulator 16 never completely empties to achieve the valve-open equilibrium pressure and never completely fills to achieve the valve-closed equilibrium pressure. Importantly, the desired time-average value of the of the fuel flow rate, which is established by the main fuel control valve, is not affected by the total flow of fuel from the accumulator 16, or the PERM technique.

Figure 4:
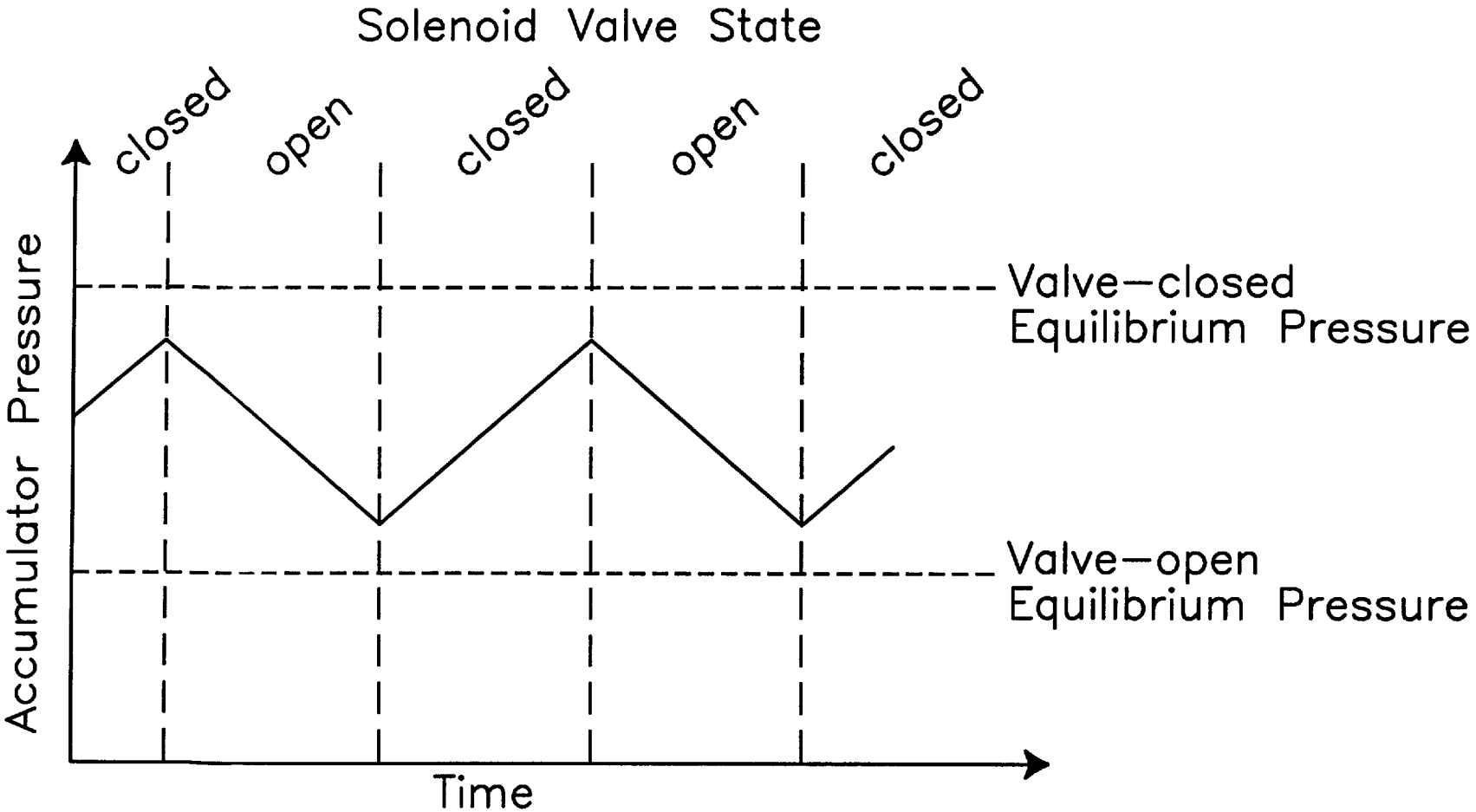
FIG. 4 is a graphical illustration of the modulation of the accumulator pressure between valve-open and valve-closed equilibrium pressures.

FIG. 4 is a graphical illustration of the modulation of the pressure within the accumulator between the valve-open equilibrium pressure and the valve-closed equilibrium pressure, resulting from the periodical cycling the solenoid valve 18 from open and closed positions. As shown in FIG. 4, when the solenoid valve 18 is opened, the accumulator pressure drops toward the valve-open equilibrium pressure, and the flow of fuel into the fuel nozzle 12 is increased as the accumulator empties of fuel. When the solenoid valve 18 is closed, the accumulator pressure rises, and the fuel flow into the fuel nozzle 12 is reduced as the accumulator fills with fuel.

Figure 5:
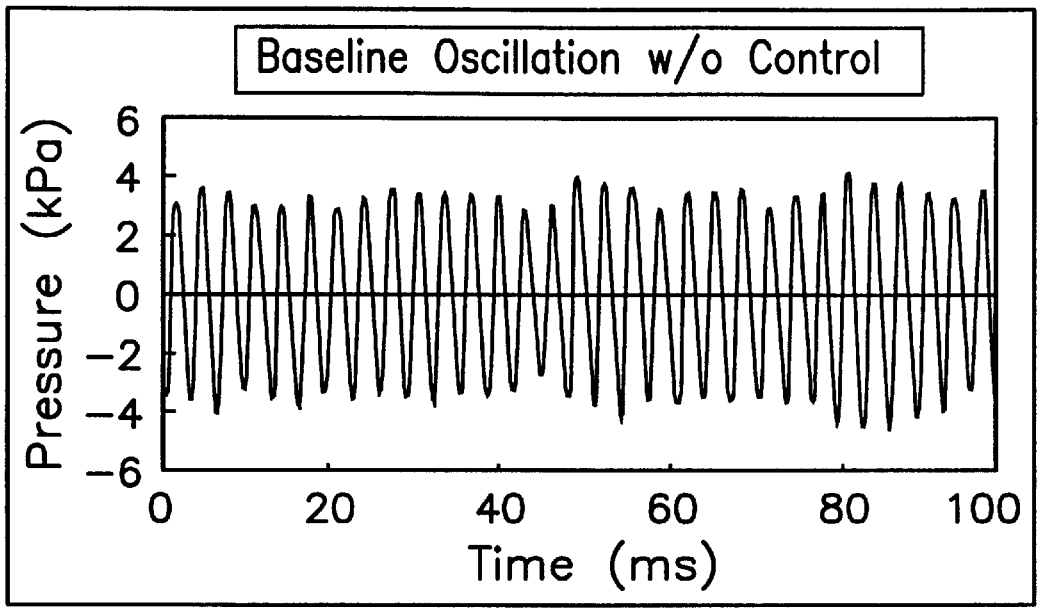
FIG. 5 is a graphical representation of combustor oscillation without the PERM control activated for an island shaped oscillation region.
Figure 6:
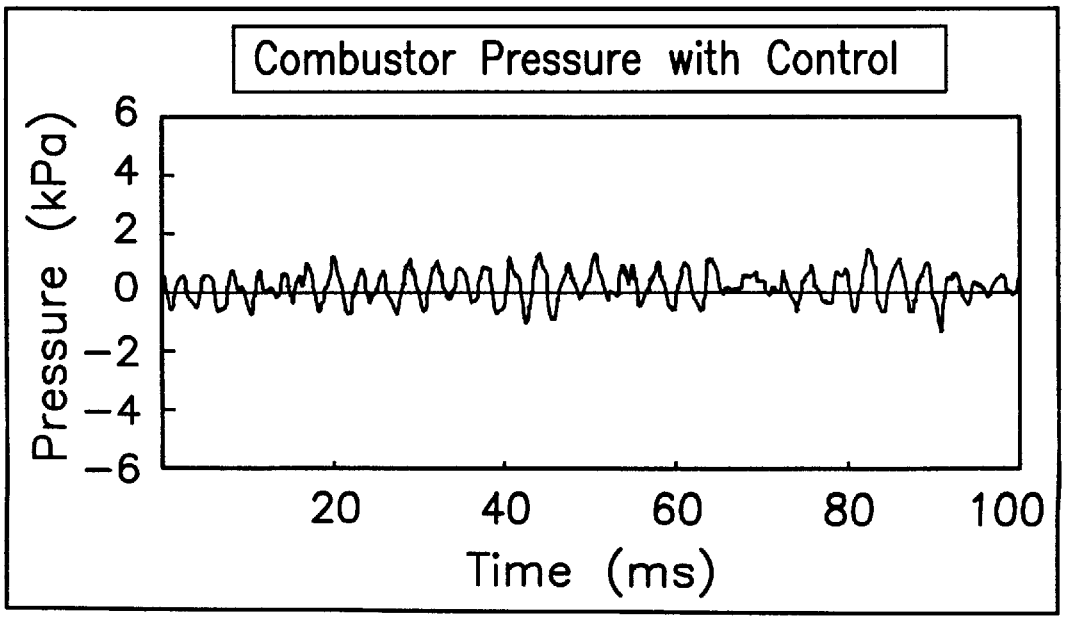
FIG. 6 is a graphical representation of combustor oscillation with the PERM control activated for an island shaped oscillation region.
Figure 7:
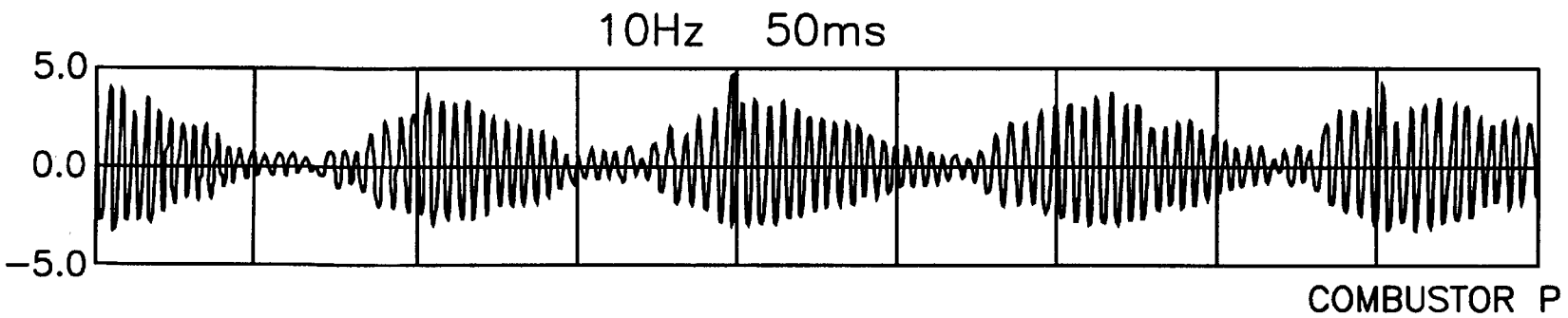
FIG. 7 is a graphical representation of combustor oscillation stability with the PERM control activated for a single-sided shaped oscillation region.

FIGS. 5, 6, and 7 show the pressure oscillations within a combustion chamber, with and without activating the PERM control. When a combustion device is operating in an unstable condition, the pressure oscillations within the combustion chamber have large amplitudes. Similarly, when the combustion device is operating in a stable condition, the pressure oscillations within the combustion chamber have small amplitudes. FIG. 5 shows a time history of the pressure oscillations within a combustion chamber for a combustion device operating in an island-shaped oscillation region, without the PERM control activated. In comparison, FIG. 6 graphically demonstrates the much improved and stabler operating condition for same combustion device, incorporating the PERM active control, whereby the equivalence ratio is periodically modulated, such that the actual operating point alternates between two reference points on either side of the island shaped oscillation region.

FIG. 7 shows a time history of the pressure oscillations within a combustion chamber for a combustion device having a desired operating point within a single-sided region, with the PERM active control, whereby the equivalence ratio is modulated to alternate the actual operating point between a reference point within the oscillation region and a reference point outside of the oscillation region. Although the stability of the combustion device is improved in the single-sided case, the oscillation is not completely mitigated by the PERM technique. Therefore, for combustion devices having single-sided oscillation regions, multiple fuel injectors are ideally incorporated in the combustion design, such that the PERM technique is applied to the individual fuel injectors or nozzles to reduce overall combustion instability.

The PERM technique of the present method and apparatus is critically different from a fuel metering system in that it does not meter fuel, but rather generates a pulse of fuel in addition to the system fuel flow rate, without changing the time-average fuel flow rate, which continues to be controlled by the existing hardware (main fuel line control valve) of the combustion device. In fact, the PERM apparatus is positioned downstream of any main fuel line control or metering device.

The accumulator must have a volume that is sized to meet the expected flow rates and pressure drops associated with the nozzle hardware and combustion operating conditions. For example, if the accumulator volume is too small, opening the solenoid valve will quickly empty the accumulator and no sizable pulse will be produced. Preferably, the solenoid valve is actuated, such that the desired fuel pulse is produced, while the accumulator pressure remains substantially unchanged. It is appreciated in the art to design and size the accumulator volume and associated system hardware in accordance with the mass balance equation for accumulator volume with pulsed output. The mass balance equation is further used to convert accumulator pressure measurements into pulse flow rate.

EXAMPLE 1

The PERM method and apparatus was demonstrated by first establishing oscillating combustion under the conditions provided in Table 1. The lean premix (LPM) stoichiometric equivalence ratio of 10.0 was based on average natural gas composition, whereby the stoichiometric mixture ratio ranged between 9.8 and 10.2 air/fuel, volume bases.

TABLE 1

| | |
|---|---|
| Operating Pressure | 100 psig |
| Inlet Temperature | 625° F. |
| LPM Equivalence Ratio | 0.58 |
| % Pilot | 8.4 |
| Reference Velocity | 68.7 m/s |

After an unstable operating condition was established, the solenoid valve was actuated to produce oscillating fuel delivery to the main fuel line (fuel manifold). The instantaneous variation in fuel flow ranged from 0 to 30% of the total LPM flow. The actual percentage of fuel flow variation depends on the operating conditions and the pulse width. Depending on the frequency of pulse, the time-average equivalent flow that is participating in PERM may be very small. For example, a 10 Hz pulse, (i.e. 100 ms period), with a 20 ms duration is active only 20 ms/100 ms or ⅕ of the time. Thus, on a time-average basis, an instantaneous variation in LPM fuel of 30% will use only ⅕×30%, or 6%, of the total LPM flow.

Figure 8:
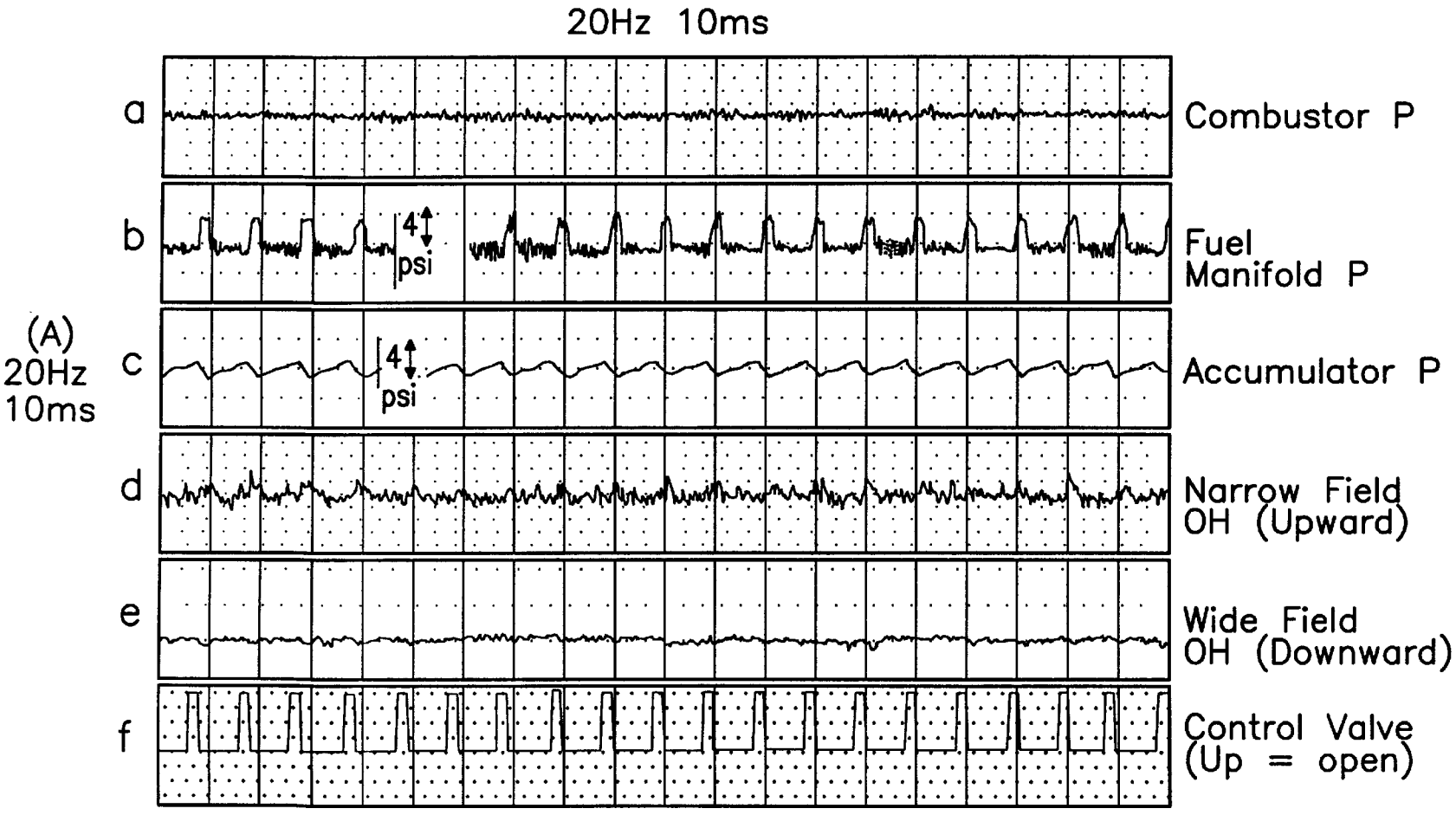
FIG. 8 is a time history graph of various combustor measurements with the solenoid valve pulsed at 20 Hz, with a pulse width of 10 ms.
Figure 9:
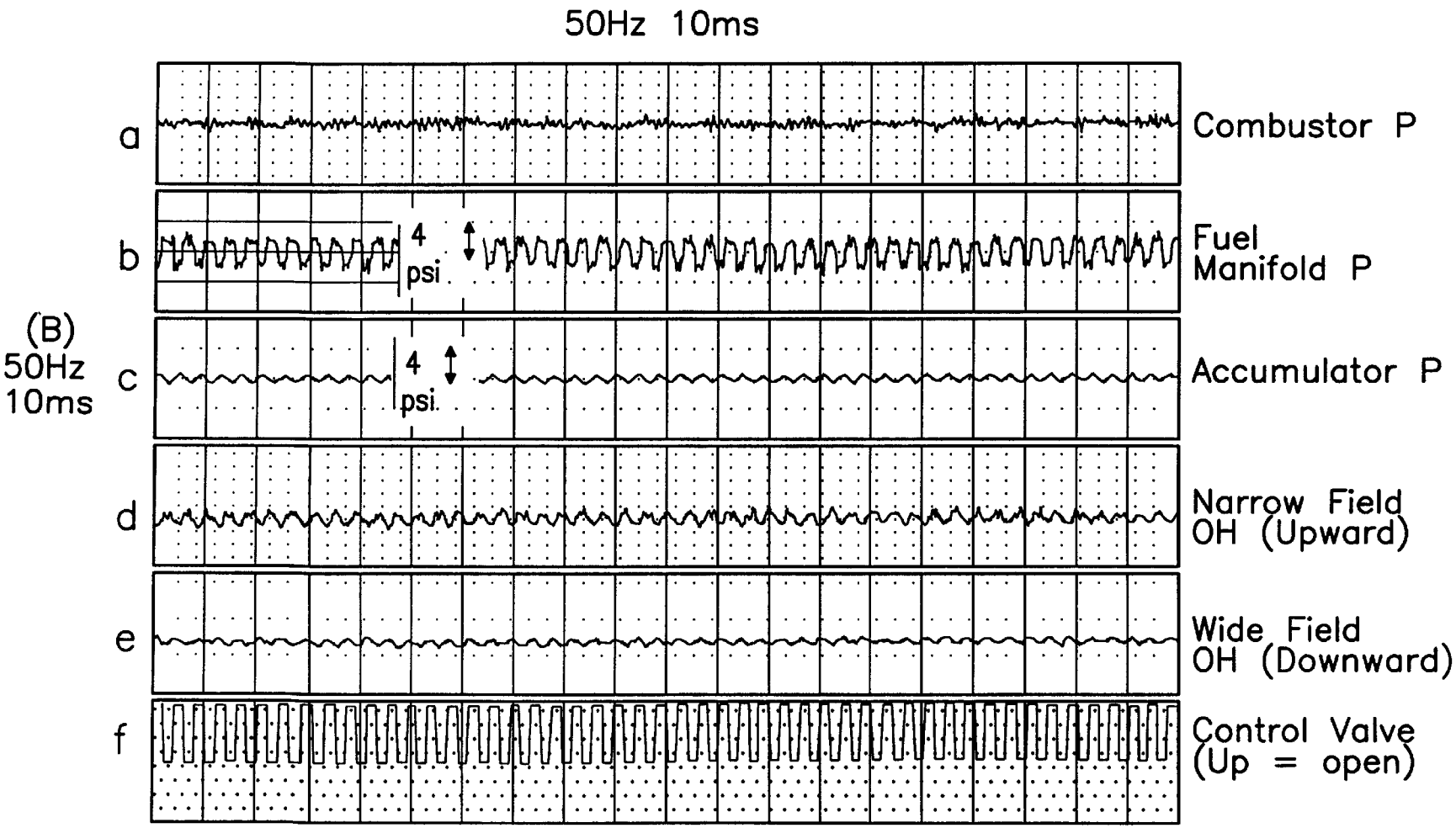
FIG. 9 is a time history graph of various combustor measurements with the solenoid valve pulsed at 50 Hz, with a pulse width of 10 ms.

FIGS. 8 and 9 are time history graphs of various combustor measurements with the solenoid valve pulsed at 20 Hz and 50 Hz, respectively, with a pulse width of 10 ms for both cases. The action of the open/close actuation of the solenoid valve is demonstrated in the CONTROL VALVE graphs. The effect of actuating the solenoid on the combustion device's component parts is demonstrated in the COMBUSTOR PRESSURE, FUEL MANIFOLD PRESSURE, and ACCUMULATOR PRESSURE graphs. Importantly, the COMBUSTOR PRESSURE graphs show a steady combustor pressure, unaffected by the active control fuel pulses. This is significant because the active control fuel pulse should not produce "chugging" pressures at the control frequency. In other words, the low frequency fuel pulses must not produce repeated pressure pulses that are unacceptable for turbo machinery operation.

The FUEL MANIFOLD PRESSURE graphs illustrate by their square shape and position that the pressure in the main fuel line is oscillating in response to the control action of the fuel pulses generated by the solenoid valve and changes in the LPM flow. The ACCUMULATOR PRESSURE graphs exhibit a sawtooth shape, which also corresponds to the active control of the solenoid valve. The height of the sawtooth shape indicates the amount of fuel modulated. The effect of the fuel modulation on pressure conditions within the combustion chamber was further monitored by OH probes, which measured the heat release rate (amount of fuel and air burning) within the combustion chamber, during PERM operation. The OH probes were positioned across the combustor diameter for viewing a narrow field at an upward gain and a wide field at a downward gain. The field of view was perpendicular to the combustor axis, one inch downstream of the fuel nozzle. The OH signals, represented in graphs NARROW FIELD and WIDE FIELD, indicated that the PERM active control produces a weak signal in the heat release for the 20 Hz case and a very clear signal for the 50 Hz case. Importantly, however, for both cases, PERM does not result in a large equivalence ratio shift. A large shift in the equivalence ratio would also produce a large shift in temperature, resulting an increase in pollution ($NO_x$) emissions.

The PERM technique was tested for three cases where the desired operating point for the rate of fuel flow was within an oscillation region: (1) periodically modulating the equivalence ratio, such that the actual operating point periodically modulated between two reference points on either side of an island shaped oscillation region; (2) periodically modulating the equivalence ratio, such that the actual operating point periodically modulated between a first reference point within the oscillation region and a second reference point outside of the oscillation region (the single-sided case); and (3) periodically modulating the equivalence ratio between two reference points within the oscillation region. The best control was achieved in the first island shaped case, and especially when the combustion system spent half the time at each stable reference point. The second case achieved near control, but not complete control. However, for the single-sided case, control is much improved by applying the PERM technique to multi-nozzle combustors, as described in detail below. The final case did not show any significant effect from PERM.

A further preferred embodiment and valuable application of the PERM technique is to use the PERM technique to control oscillations in a multi-nozzle combustion engine design. In this embodiment, the PERM technique is applied to a plurality of fuel injectors, such that the equivalence ratio for certain fuel injectors is modulated at certain times. For example, the equivalence ratio for a first fuel injector is modulated, such that the operating point is moved to a stable condition outside of the oscillation region, while the equivalence ratio for a second fuel injector is modulated, such that the operating point is moved to an unstable condition within the oscillation region. FIGS. 10 and 11 show modulation of the equivalence ratio for two nozzles, Nozzle A and Nozzle B, whereby each nozzle is alternately shifted between a stable and unstable condition. FIG. 12 demonstrates that a plot of the equivalence ratio produced by each nozzle is 180° out of phase. The net effect of the PERM technique applied to Nozzles A and B is to increase damping for either nozzle operating in the oscillation region.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments described explain the principles of the invention and practical applications and should enable others skilled in the art to utilize the invention in various embodiments and with various modifications as are suited to the particular use contemplated. While the invention has been described with reference to details of the illustrated embodiment, these details are not intended to limit the scope of the invention, rather the scope of the invention is to be defined by the claims appended hereto.

The embodiments of the invention in which an exclusive property or privilege is claimed are defined as follows:

1. A method for actively controlling combustion instability for a combustion device, comprising the steps of:

constructing a graph of air flow rate versus equivalence ratio for the operating range of the combustion device, wherein air flow rate is the rate of air supplied to the combustion chamber and equivalence ratio is the ratio of the actual fuel/air ratio to the stoichiometric fuel/air ratio;

identifying on the graph an oscillation region defined by unstable combustion chamber conditions for a range of air flow rate versus a range of equivalence ratio values;

locating a desired operating point for the combustion device within the identified oscillation region, wherein the desired operating point corresponds to a desired air flow rate, a desired equivalence ratio, and a desired time-average equivalence ratio;

selecting two reference points on the graph, wherein at least one reference point is outside of the identified oscillation region; and modulating the equivalence ratio, such that an actual operating point for the combustion device alternates between the two reference points on the graph.

2. A method according to claim 1, wherein the first reference point is the desired operating point.

3. A method according to claim 1, wherein the first and second reference points are outside of the identified oscillation region, and wherein the first reference point corresponds to an equivalence ratio value less than the desired equivalence ratio value and the second reference point corresponds to an equivalence ratio value greater than the desired equivalence ratio value.

4. A method according to claim 3, wherein the first and second reference points correspond to the desired air flow rate.

5. A method according to claim 1, wherein the first reference point is outside of the identified oscillation region and the second reference point is within the identified oscillation region.

6. A method according to claim 5, wherein the first and second reference points correspond to the desired air flow rate.

7. A method according to claim 1, wherein the modulation step comprises injecting pulses of fuel into means for delivering fuel to the combustion chamber.

8. A method according to claim 7, wherein the pulse injection step comprises injecting fuel pulses at a low frequency, whereby the desired time-average equivalence ratio is unaffected by the pulsed fuel injection.

9. A method according to claim 7, wherein the pulse injection step comprises periodically modulating the fuel flow, whereby the time-average fuel flow rate within the fuel delivery means is unaffected by the pulsed fuel injection.

10. A method according to claim 7, wherein the injected fuel pulses have a duration of about 10 ms.

11. A method according to claim 7, wherein the pulse injection step comprises injecting fuel pulses at a frequency of between about 1 Hz and about 100 Hz.

12. A method according to claim 7, wherein the pulse injection step comprises injecting fuel pulses at a frequency of about 20 Hz.

13. A method according to claim 7, wherein the pulse injection step comprises injecting fuel pulses at a frequency of about 50 Hz.

14. A method for actively controlling combustion instability for a combustion device having a plurality of fuel injectors, comprising:

constructing a graph of air flow rate versus equivalence ratio for the operating range of the combustion device for each fuel injector, wherein air flow rate is the rate of air supplied to the fuel injector and equivalence ratio is the ratio of the actual fuel/air ratio to the stoichiometric fuel/air ratio;

identifying an oscillation region defined by unstable combustion chamber conditions for a range of air flow values versus a range of equivalence ratios for each fuel injector;

locating a desired operating point for each fuel injector within the corresponding identified oscillation region, wherein each desired operating point corresponds to a desired air flow rate and a desired equivalence ratio for the fuel injector;

selecting two reference points on each graph, wherein at least one reference point is outside of the identified oscillation region; and modulating the equivalence ratio for at least one fuel injector, such that an actual operating point for the combustion device periodically moves between the two reference points on the graph for the fuel injector.

15. A method according to claim 14, wherein the combustion device has two fuel injectors and the modulation step comprises periodically modulating the equivalence ratios of the first and second fuel injectors 180° out of phase.

16. A method for actively controlling combustion instability within a combustor operating in an unstable condition, comprising the steps of:

providing an accumulator having an inlet port for receiving fuel and an outlet port having a solenoid valve for periodically discharging fuel;

creating a pressure drop within a main fuel line for delivering fuel to a combustion chamber within the combustor at a desired time-average fuel flow rate, such that the pressure in an upstream section of the main fuel line is greater than the pressure in a downstream section of the main fuel line;

connecting the accumulator inlet port to the upstream section of the main fuel line;

connecting the accumulator outlet port to the downstream section of the main fuel line;

identifying a range of equivalence ratio values, wherein the combustor operates in a stable condition; and periodically opening and closing the solenoid valve to inject fuel pulses into the main fuel line, thereby modulating the equivalence ratio of the fuel/air mixture within the combustion chamber, such that the combustor operates in alternating stable and unstable conditions, and the desired time-average fuel flow rate is unaffected by the pulsed fuel injections.

17. An apparatus for actively controlling the instability within a combustion chamber, comprising:

providing a combustor having a combustion chamber, wherein undesired pressure oscillations within the combustion chamber cause the combustor to operate in an unstable state;

means for delivering fuel at a desired time-average fuel flow rate to the combustion chamber; and means for periodically injecting a pulse of fuel into said fuel delivering means, whereby the equivalence ratio of the fuel/air mixture within the combustion chamber is modulated, such that the combustor alternates between a stable operating state and the unstable operating state, and the desired time-average fuel flow rate is unchanged.

18. An apparatus according to claim 17, wherein said fuel delivering means is a main fuel line having a nozzle.

19. An apparatus according to claim 17, wherein said pulse injection means is comprised of:

an accumulator for containing a reservoir of fuel for periodic injection into said fuel delivering means, said accumulator having an inlet port and an outlet port;

means for creating a pressure drop between the inlet port and the outlet port of said accumulator;

a solenoid valve connected to the outlet port of said accumulator for controlling the amount of fuel in said accumulator; and means for actuating said solenoid valve.

20. An apparatus according to claim 19, wherein said actuating means is a driving circuit.

* * * * *